US006248003B1

(12) United States Patent
Hoshiya et al.

(10) Patent No.: US 6,248,003 B1
(45) **Date of Patent: *Jun. 19, 2001**

(54) METHOD OF TRUING GRINDING WHEEL AND DEVICE USED IN PERFORMING SUCH METHOD

(75) Inventors: Kiyoharu Hoshiya; Shinji Kohsaka, both of Minokama (JP)

(73) Assignee: San-ei Seiko Co., Ltd. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/876,986

(22) Filed: Jun. 16, 1997

(30) Foreign Application Priority Data

Jun. 19, 1996 (JP) ..... 8-158389

(51) Int. Cl.[7] ..... B24B 53/00

(52) U.S. Cl. ..... 451/56; 451/443; 451/70; 451/324; 451/173

(58) Field of Search ..... 451/56, 443, 444, 451/67, 68, 70, 324, 164, 173

(56) References Cited

U.S. PATENT DOCUMENTS

| | | | |
|---|---|---|---|
| 4,020,820 | 5/1977 | Kish . | |
| 4,555,873 | * 12/1985 | Smith | 451/56 |

FOREIGN PATENT DOCUMENTS

| | | |
|---|---|---|
| 2438600 | 2/1976 | (DE) . |
| 3718622 | 12/1988 | (DE) . |
| 0433829A2 | 6/1991 | (EP) . |
| 07053260 | 8/1996 | (EP) . |
| 2044146 | 10/1980 | (GB) . |

* cited by examiner

*Primary Examiner*—Eileen P. Morgan
(74) *Attorney, Agent, or Firm*—Patterson, Thuente, Skaar & Christensen, P.A.

(57) ABSTRACT

A method of truing a grinding wheel includes the steps of providing a material containing a metallic material selected from the group consisting of metals in groups IVA, VA and VIA of the periodic table and alloys thereof, rotating a grinding wheel having a treatment surface to be trued, and contacting the material with the treatment surface of the grinding wheel.

4 Claims, 5 Drawing Sheets

METHOD OF TRUING GRINDING WHEEL AND DEVICE USED IN PERFORMING SUCH METHOD

BACKGROUND OF THE INVENTION

1. Field of the Invention

The present invention relates to a method for truing a grinding wheel, that is, reshaping the grinding wheel or compensating for asymmetric wear of the grinding wheel, and a device used to perform such a method.

2. Description of the Prior Art

A so-called "super grinding wheel," which contains diamond particles, CBN (cubic boron nitride) particles or similar particles as the abrasive grain, is well known in the grinding industry. In recent years, workpieces have become more difficult to grind, because various types of abrasion resistive materials have become widely used in many industries. In addition, there are strong demands to increase the dimensional precision and the grinding efficiency of the workpieces. As a result, the use of such a super grinding wheel has rapidly grown.

Conventional methods for truing the super grinding wheel may involve (1) utilizing a diamond tool, such as a single diamond dresser, a diamond impregnated dresser and a block dresser, (2) utilizing a block-like grindstone or a rotary grindstone made of GC (SiC), WA ($AL_2O_3$) and similar materials, and (3) utilizing a tool made of mild steel (which will be referred to as a "mild steel grinding method").

However, method (1) requires a lengthy dressing operation to restore the grinding power of the grinding wheel that must be performed after the truing operation is completed, because the abrasive grain particles protruding from the treatment surface of grinding wheel are worn during the truing operation, such that the tip of each abrasive grain particle is substantially flattened. This may lower the efficiency of the truing operation and decrease the precision of the trued grinding wheel. In addition, this method may cause the truing tool to wear rapidly, thus resulting in increased truing costs.

Further, each of methods (2) and (3) does not provide sufficient truing power. Therefore, it may take a long time to true the grinding wheel.

Moreover, conventional methods for truing the super grinding wheel also involve (4) utilizing a brake truer, such as a rotary dresser, a diamond wheel and other rotary tools, (5) a lapping method utilizing uncombined or free abrasive particles, (6) a crush roller method in which a rotating cylindrical metal is pressed against the grinding wheel to be treated, and (7) an electrical or non-contact method utilizing an electrical discharge.

Each of methods (4) to (7), when applied to the super grinding wheel, also does not provide satisfactory truing capability. Also, each of these methods has a limited range of application. Thus, such methods are not suitable for application to various types of grinding machines (including double-disk grinding machines or special purpose grinding machines). Further, such methods cannot be applied to various types of super grinding wheels in which the abrasive grain particles are combined using different types of binding agents.

SUMMARY OF THE INVENTION

Therefore, it is desired to provide a method that may speedily and easily true a super grinding wheel at a relatively lower cost and may be applied to various types of grinding machines. Further, it is preferable that the method can be performed in situ, that is, without detaching the grinding wheel to be trued from the grinding machine and does not require an additional operation to dress the grinding wheel.

The present inventors have studied the truing mechanism of the conventional mild steel grinding method. Consequently, it has been found that in order to true the super grinding wheel with high efficiency, the binding agent for the abrasive grain particles of the super grinding wheel must be effectively removed during the truing operation. They have further studied and discovered that, in order to effectively remove the binding agent, it is necessary to induce a solid phase diffusion reaction or other chemical reactions between the binding agent of the super grinding wheel and the truing device material. Moreover, it has been found as a result of additional tests that metals located in groups IVA, VA and VIA of the periodic table or alloys thereof may exhibit excellent truing capability for the super grinding wheel.

It is an object of the invention to eliminate the problems associated with the conventional methods, that is, to provide an improved method of truing a grinding wheel with high efficiency and a device used in performing such a method.

In order to attain this object, the present invention provides a method for truing a grinding wheel including the steps of providing a material containing a metallic material selected from the group consisting of metals in groups IVA, VA and VIA of the periodic table and alloys thereof, rotating a grinding wheel having a treatment surface to be trued, and grinding the metallic material with the treatment surface of the grinding wheel.

According to the present method, a binding agent contained in the grinding wheel and the metallic material selected from the group consisting of metals in groups IVA, VA and VIA of the periodic table may react to induce a solid phase diffusion reaction and other chemical reactions on the treatment surface of the grinding wheel, thereby forming a brittle compound. The brittle compound may be easily removed from the treatment surface of the grinding wheel during the truing operation. Further, a portion of the binding agent of the grinding wheel can be mechanically removed from the treatment surface.

Therefore, the present method may true various types of grinding wheels with high efficiency. Further, the present method does not require an additional dressing operation after the grinding wheel has been trued. This may lead to decreased truing costs and decreased truing time.

The present invention will become more fully apparent from the claims and the description as it proceeds in connection with the drawings.

DETAILED DESCRIPTION OF THE PREFERRED EMBODIMENTS

Figure 1:
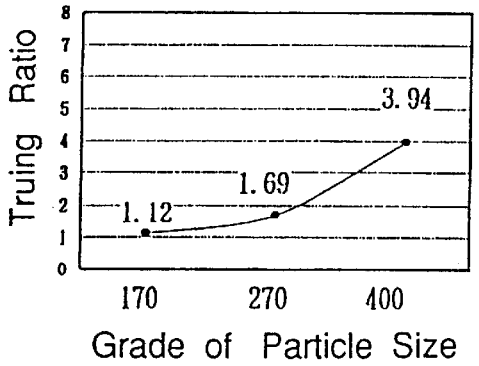
FIG. 1 is a graph showing the relation between particle size of the abrasive grain of a super grinding wheel to be trued and a truing ratio.

A preferred embodiment of the present invention will now be described in detail with reference to the drawings.

The present invention relates to a method for truing a grinding wheel, and more particularly to a method for truing a super grinding wheel that essentially consists of abrasive grains, such as diamond particles and CBN particles, and a binding agent for binding the abrasive grains. A truing device used to perform such a method is also described. It is important to note that the binding agent used in the super grinding wheel comprises a metal binder, a resin binder, a vitrified binder and other binder materials. Also, the present invention is intended to be applied to various types of grinding machines, each having such a super grinding wheel.

The truing device according to the present invention has a contacting member which is made of metals in groups IVA, VA and VIA of the periodic table (which will be referred to as the "present metals" hereinafter) or alloys thereof (which will be referred to as the "present alloys" hereinafter).

Although the present metal may be titanium (Ti), zirconium (Zr), hafnium (Hf), vanadium (V), niobium (Nb), tantalum (Ta), chromium (Cr), molybdenum (Mo) and tungsten (W) in groups IVA, VA and VIA, the preferred metals for the present metal are vanadium (V), niobium (Nb) and tantalum (Ta) in group VA. These metals may readily react with the binding agent of the super grinding wheel to induce a solid phase diffusion reaction or other chemical reactions between the binding agent and the present metal. Specifically, these metals may react with tin (Sn), gallium (Ga), silicon (Si), aluminum (Al) or other elements to produce intermetallic compounds. Therefore, each of these metals and alloys thereof is suitable for the contacting member of the truing device when the super grinding wheel to be trued contains bronze or a copper-tin (Cu—Sn) alloy as the binding agent.

For example, if a super grinding wheel containing bronze as the binding agent is treated by utilizing a truing device having a contacting member made of niobium or an alloy thereof, the niobium contained in the contacting member of the truing device and the tin contained in the binding agent of the super grinding wheel react to induce the solid phase diffusion reaction and the other chemical reactions on the treatment surface of the super grinding wheel, thereby forming the bimetallic compound "$Nb_3Sn$" on the treatment surface. Such reactions will occur at temperatures around 700° C. The bimetallic compound as produced may be easily removed from the treatment surface of the super grinding wheel during the truing operation, because the bimetallic compound is very brittle. Further, the contacting member made of niobium or an alloy thereof does not excessively wear the abrasive grain particles of the super grinding wheel during the truing operation. Therefore, the trued super grinding wheel is not required to be additionally treated or dressed to restore grinding power to the super grinding wheel.

Figure 4:
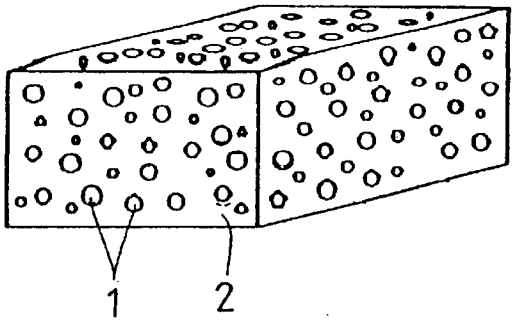
FIG. 4 is a perspective view of a contacting member of the truing device made of a hybrid material.

As described above, the contacting member of the truing device is preferably made of the present metals and the present alloys. However, as shown in FIG. 4, the contacting member of the truing device can be made of a material having a microscopic structure or a hybrid material. The hybrid material consists of truing particles 1 made of the present metals or present alloys (which will be referred to as the "present metallic materials" hereinafter) and a matrix 2 of additional truing materials into which the truing particles 1 are dispersed. The additional truing materials may be abrasive materials (for example, GC and WA), ceramic materials, general metals (for example, mild steel), with the exception of the present metallic materials, and alloys of such general metals.

Figure 5:
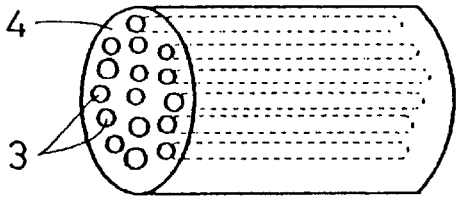
FIG. 5 is a perspective view of a contacting member of the truing device made of a composite material.

Also, as shown in FIG. 5, the contacting member of the truing device can be made of a material having a macroscopic structure or a composite material. The composite material consists of rod-like truing elements 3 made of the present metallic materials and a cylindrical matrix 4 of the additional truing materials into which the truing elements 3 are embedded.

Further, as shown in each of FIGS. 6 to 13, the contacting member of the truing device can be made of a modified composite material. The composite material consists of one or more truing elements 5 of the present metallic materials and one or more matrixes 6 of the additional truing materials to which the truing elements 5 are combined. The truing elements 5 may be combined with the matrixes 6 by brazing or welding or by utilizing adhesives or screws.

Figure 6:
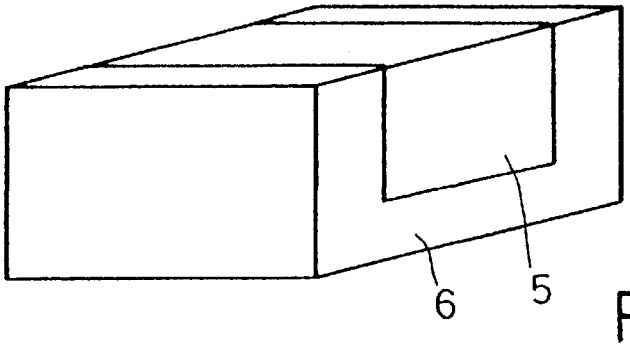
FIG. 6 is a perspective view of a contacting member of the truing device made of another composite material.
Figure 7:
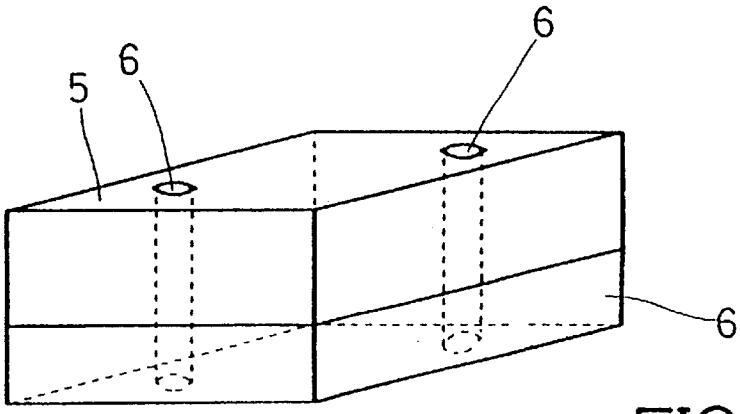
FIG. 7 is a perspective view of a contacting member of the truing device made of a further composite material.
Figure 8:
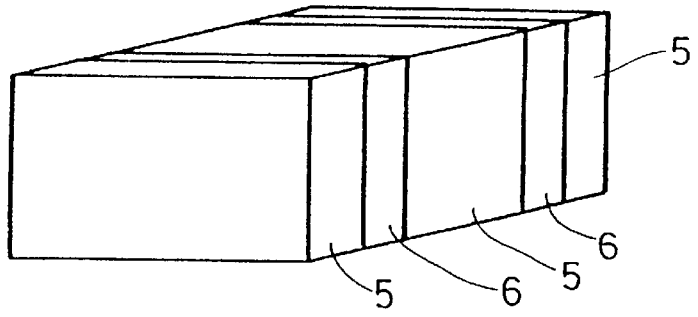
FIG. 8 is a perspective view of a contacting member of the truing device made of a further composite material.
Figure 9:
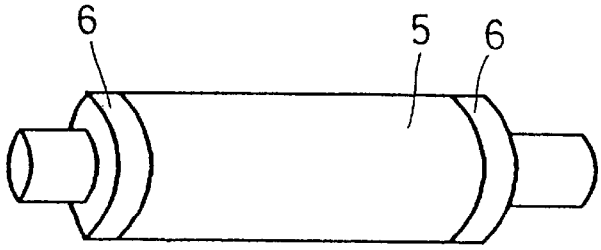
FIG. 9 is a perspective view of a contacting member of the truing device made of a further composite material.
Figure 10:
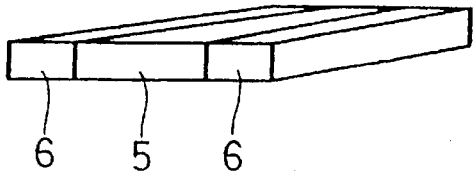
FIG. 10 is a perspective view of a contacting member of the truing device made of a further composite material.
Figure 11:
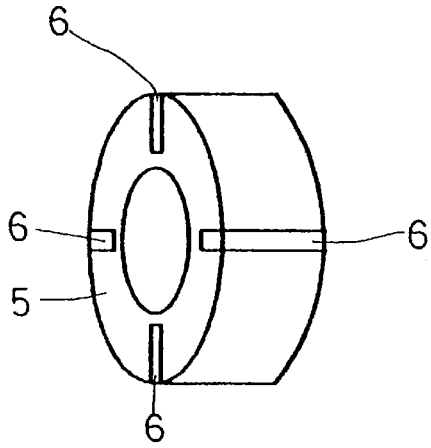
FIG. 11 is a perspective view of a contacting member of the truing device made of a further composite material.
Figure 12:
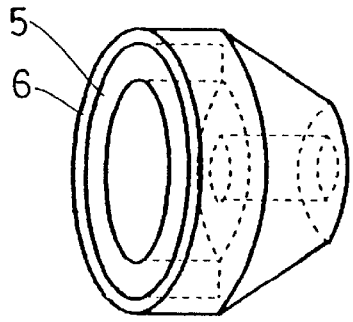
FIG. 12 is a perspective view of a contacting member of the truing device made of a further composite material.

The contacting member of the truing device shown in each of FIGS. 6 to 8 has a parallelepiped block-like shape and is suitable for a surface-grinding machine. The contacting member of the truing device shown in FIG. 9 has a cylindrical shape and is suitable for a cylindrical grinding machine or a center-less grinding machine. The contacting member of the truing device shown in FIG. 10 has a plate-like shape and is suitable for a double-disk grinding machine. The contacting member of the truing device shown in FIG. 11 has a substantially thickened disk-like shape and is suitable for a profile grinding machine or a cutting machine having a thin abrasive cutting wheel. The contacting member of the truing device shown in FIG. 12 has a substantially tapered thickened disk-like type and is also suitable for the profile grinding machine or the cutting machine.

The contacting member of the truing device of the present invention may have various kinds of forms, such as a disk-like form and a rod-like form (a round rod-like form and a square rod-like form), so as to be used with conventional methods. That is, the contacting member of the truing device having the disk-like form can be used as the rotary tool of a conventional brake truer. Further, the contacting member of the truing device having the rod-like form can be substituted for the diamond tool in the conventional method.

Figure 13:
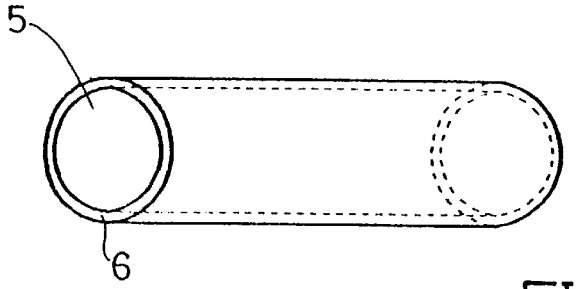
FIG. 13 is a perspective view of a contacting member of the truing device made of a still further composite material.

For example, the contacting member of the truing device shown in FIG. 13 has a cylindrical shape and can be preferably substituted for the diamond tool used in the conventional method. Also, the contacting member of the truing device shown in FIG. 11 can be preferably substituted for the diamond tool used in the conventional method.

Like the conventional truing device, the present truing device having the contacting member can be mounted on a truing machine or a grinding machine by utilizing (1) magnetic force or (2) the mechanical force of a fastener, such as a chuck, a screw or a coupler. For example, the truing device shown in FIG. 4 or 5 can be mounted on the truing machine utilizing magnetic force if it exhibits ferromagnetic properties. The truing device having the contacting member shown in FIG. 6, 7 or 8 can be mounted on the truing machine utilizing magnetic force if the matrix exhibits ferromagnetic properties. Further, the truing device having the contacting member shown in FIG. 9 will be mounted on the truing machine by a chuck or the like.

Figure 14:
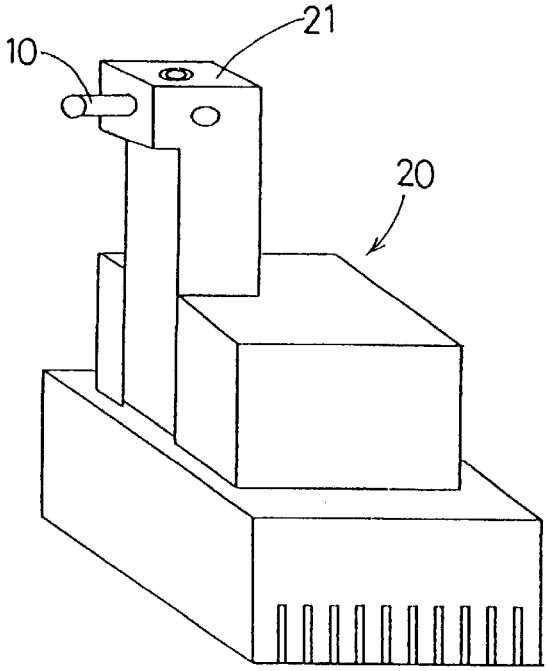
FIG. 14 is a perspective view of a truing machine on which the truing device is mounted.
Figure 15:
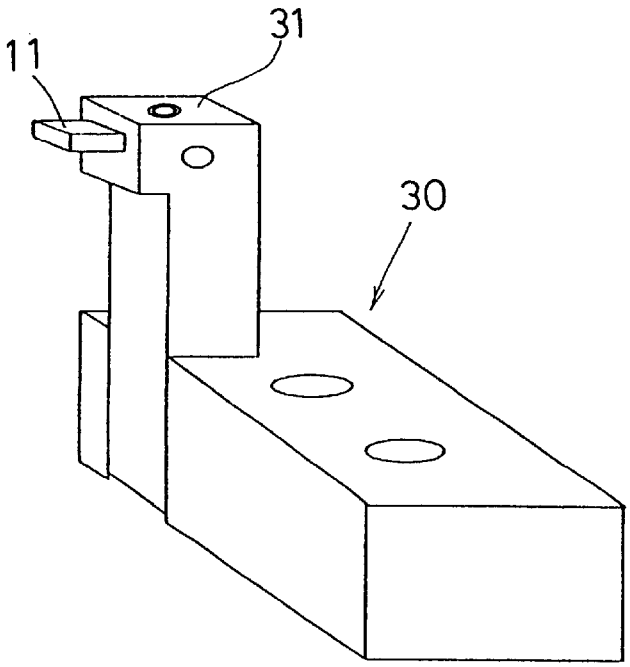
FIG. 15 is a perspective view of another truing machine on which the truing device is mounted.

Referring to FIGS. 14 and 15, truing machines are shown having the truing device of the present invention. As shown in FIG. 14, the truing machine 20 includes a support strut 21 on which the truing device 10 having the rod-like contacting member is mounted. As shown in FIG. 15, the truing machine 30 includes a support strut 31 on which the truing device 11 having the plate-like contacting member or the block-like contacting member is mounted. The truing machines 20 and 30 may be applied to true the super grinding wheel for contouring which is used in the profile grinding machine.

Figure 16:
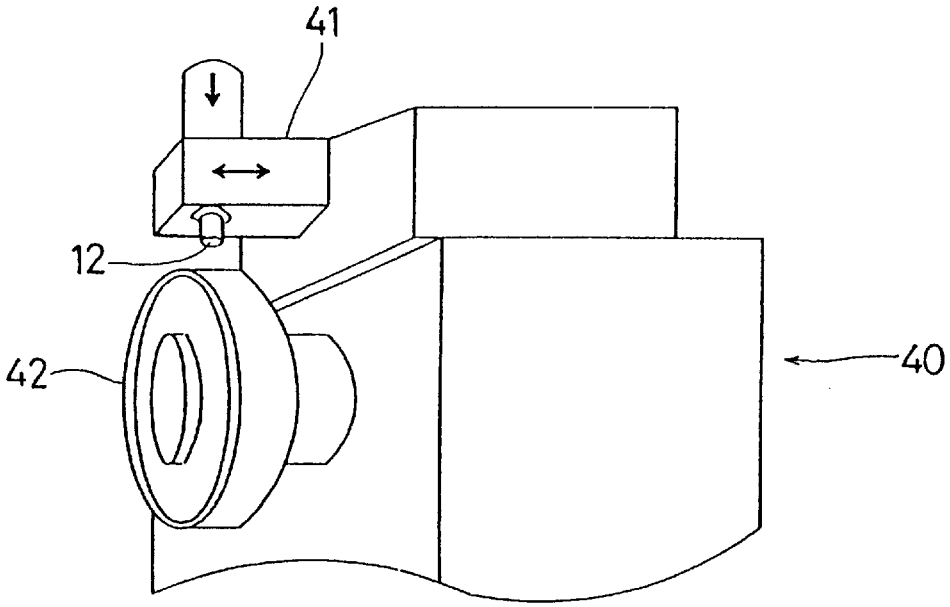
FIG. 16 is a perspective view of a flat grinding machine on which the truing device is mounted.

Referring now to FIG. 16, a flat grinding machine is shown having the truing device of the present invention. As shown in FIG. 16, the flat grinding machine 40 includes a dressing mechanism 41 on which the truing device 12 is assembled. The truing device 12 is adapted to move in the directions as indicated by arrows, so that a super grinding wheel 42 of the grinding machine 40 is trued and dressed on the grinding machine 40. The truing device 12 can be mounted on the workpiece carrier (not shown) of the grinding machine and not the dressing mechanism 41, if necessary.

The following examples are provided to further illustrate the present invention and are not to be construed as limiting the invention.

In the examples, unless otherwise specified, a computerized numerical control (CNC) flat grinding machine having a super grinding wheel was used as the grinding machine. The super grinding wheel to be trued was trued by plunge cutting the contacting member of the truing device. The super grinding wheel was a straight type and had an outer diameter of 200 mm and a width of 10 mm. The contacting member of the truing device had a width of 5 mm and a length of 50 mm. The super grinding wheel was rotated at a constant surface speed of 1700 m/min. The contacting member of the truing device was cut at a depth of cut of 2 micrometer/stroke and had a total depth of cut of 2.0 mm. Further, the contacting member of the truing device was pressed against the treatment surface of the super grinding wheel at a substantially constant pressure.

A truing ratio (x) was determined by the following equation:

$$X = \frac{\text{abrasion loss of the grinding wheel } (mm^3)}{\text{abrasion loss of the truing device } (mm^3)}$$

The abrasion loss of the grinding wheel was determined by transferring a profile of the trued grinding wheel to a carbon plate.

EXAMPLE 1

A resin bonded CBN super grinding wheel (resin bonded CBN400) was used as the super grinding wheel to be trued. Resin bonded CBN400 consists of CBN particles as the abrasive grain and the resin binder. Nine metals in the groups IVA, VA and VIA of the periodic table were utilized as samples of the contacting member of the truing device. Additionally, mild steel and WA were employed as the controls. The data for these metals are shown in Table 1 below. Further, thirty-seven alloys of these metals were also employed as samples of the contacting member of the truing device. The data for these alloys are shown in Table 2 below. In Table 2, the alloys are described in parts per weight.

TABLE 1

| Truing Device | Truing Ratio |
|---|---|
| Ti | 0.69 |
| Zr | 0.21 |
| Hf | 0.43 |
| V | 1.10 |
| Nb | 3.94 |
| Ta | 3.21 |
| Cr | 0.82 |
| Mo | 0.67 |
| W | 0.73 |
| (Control) | |
| Mild Steel | 0.17 |
| WA | 0.05 |

TABLE 2

| Truing Device | Truing Ratio | Truing Device | Truing Ratio |
|---|---|---|---|
| 50Zr-50Ti | 0.44 | 50Zr-50Hf | 0.35 |
| 50Ti-50Hf | 0.58 | 50Ta-50V | 2.19 |
| 50Ca-50Cr | 1.64 | 50Ta-50Ti | 1.45 |
| 50Ta-50Hf | 0.87 | 50Ta-50Mo | 1.88 |
| 50Ta-50W | 2.01 | 50Cr-50W | 0.86 |
| 50Cr-50Mo | 0.69 | 50Mo-50W | 0.62 |
| 50Nb-50Ta | 3.69 | 50Nb-50V | 2.21 |
| 50Nb-50Cr | 1.90 | 50Nb-50Mo | 1.77 |
| 50Nb-50W | 1.58 | 50Nb-50Ti | 2.11 |
| 80Nb-20Ta | 3.75 | 20Nb-80Ta | 3.64 |
| 80Nb-20V | 2.49 | 20Nb-80V | 1.98 |
| 70Nb-30Cr | 2.12 | 30Nb-70Cr | 1.86 |
| 70Nb-30Mo | 1.94 | 30Nb-70Mo | 1.61 |
| 60Nb-40Fe | 2.97 | 40Nb-60Fe | 2.62 |
| 40Fe-30Nb-20Ta-10V | 2.90 | 50Nb-50Cu | 2.76 |
| 50Nb-50Ni | 2.28 | 50Nb-50Al | 1.36 |
| 50Nb-50Fe | 2.85 | 50Nb-50Co | 2.14 |
| 40Nb-30Ta-30Ti | 2.86 | 25Nb-25Ta-25Ti-25V | 2.23 |
| 40Nb-30Ta-30V | 2.90 | | |

As shown in Tables 1 and 2, excellent results were obtained. Each of the present metals and the present alloys exhibited a truing ratio higher than those of the controls, that is, at least 2 to 4 times those of the controls. Each of vanadium, niobium and tantalum (the metals in group VA of the periodic table) and alloys thereof especially exhibited a truing ratio significantly higher than those of the controls. As will be apparent from Table 1, vanadium, tantalum and niobium exhibited truing ratios approximately 6 times, 18 times and 23 times greater than mild steel, respectively. Similarly, vanadium, tantalum and niobium exhibited truing ratios approximately 22 times, 64 times and 78 times greater than WA, respectively. As will be apparent from Table 2, the 50Nb—50Ta alloy, for example, exhibited a truing ratio approximately 74 times than that of WA. Moreover, each of the alloys of the present metals exhibited a truing ratio higher than those of the controls, even if the alloy contained metals, such as iron (Fe) or cobalt (Co), which are not contained in group IVA, VA or VIA of the periodic table. For example, the 50Nb—50Fe alloy exhibited a truing ratio of approximately 57 times greater than WA.

Thus, the truing device made of the present metals or the present alloys may true the resin bonded CBN super grinding wheel (resin bonded CBN400) with high efficiency.

EXAMPLE 2

A resin bonded diamond super grinding wheel (resin bonded SDC170) was used as the super grinding wheel to be trued. Resin bonded SDC 170 consists of diamond particles as the abrasive grain and the resin binder. Niobium and a 50Nb—50Ti alloy were employed as the samples of the contacting member of the truing device. Additionally, mild steel was employed as the control. The data for the metal and the alloy are shown in Table 3 below. In Table 3, the alloys are shown in parts per weight.

TABLE 3

| Truing Device | Truing Ratio |
|---|---|
| Nb | 0.696 |
| 50Nb-50Ti | 0.220 |
| (Control) | |
| Mild Steel | 0.010 |

As shown in Table 3, niobium and the 50Nb—50Ti alloy exhibited truing ratios of approximately 69 times and 22 times greater than mild steel, respectively.

Thus, the truing device of the contacting member made of niobium or the 50Nb—50Ti alloy may true the resin bonded diamond super grinding wheel (resin bonded SDC170) with high efficiency.

EXAMPLE 3

This example was conducted to demonstrate the relation between the particle size grade of the abrasive grains of the super grinding wheel to be trued and the truing ratio, as well as the relation between the degree of concentration of the super grinding wheel and the truing ratio. Several resin bonded CBN super grinding wheels having different particle size grades (i.e., grades 170, 270 and 400) were employed as the samples of the super grinding wheel to be trued. In addition, several resin bonded CEN super grinding wheels (resin bonded CBN400) having different degrees of concentration (i.e., degrees 75, 100 and 125) were employed as the samples of the super grinding wheel to be trued. Niobium was used as the contacting member of the truing device. The data are shown in FIGS. 1 and 2.

As will be apparent from FIG. 1, excellent results were obtained with regard to all of the CBN super grinding wheels. The sample having a particle size grade of 400 (fine grade) exhibited a higher truing ratio of 3.94, which is 2.3 times greater than the sample having a particle size grade of 270 and which is 3.5 times greater than the sample having a particle size grade of 170. In other words, the graph of FIG. 1 shows that as the particle size grade increases, that is, as the particle size decreases, the truing ratio increases.

Figure 2:
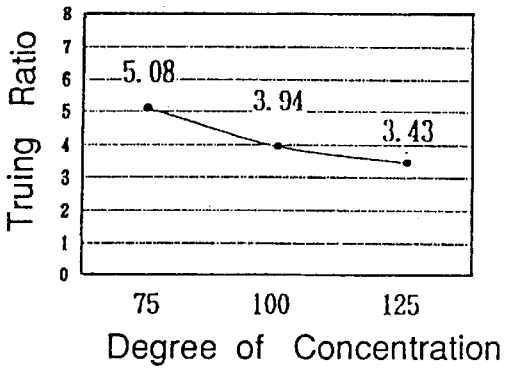
FIG. 2 is a graph showing the relation between the concentration of the abrasives of the super grinding wheel and the truing ratio.

As will be apparent from FIG. 2, excellent results were obtained with regard to all of the resin bonded CBN400. The sample having the degree of concentration of 75 exhibited a higher truing ratio of 5.08, which is 1.3 times greater than the sample having a degree of concentration of 100 and which is 1.5 times greater than the sample having a degree of concentration of 125. In other words, the graph of FIG. 2 shows that as the degree of concentration decreases, the truing ratio increases.

EXAMPLE 4

This example was conducted to demonstrate the relation between the binding agent used in the super grinding wheel to be trued and the truing ratio. Three CBN super grinding wheels (CBN400) containing different binding agents (a resin binder, a vitrified binder and a metal binder) were employed as the samples of the super grinding wheel to be trued. Niobium was used as the contacting member of the truing device. Additionally, mild steel was employed as the control. The data are shown in FIG. 3.

Figure 3:
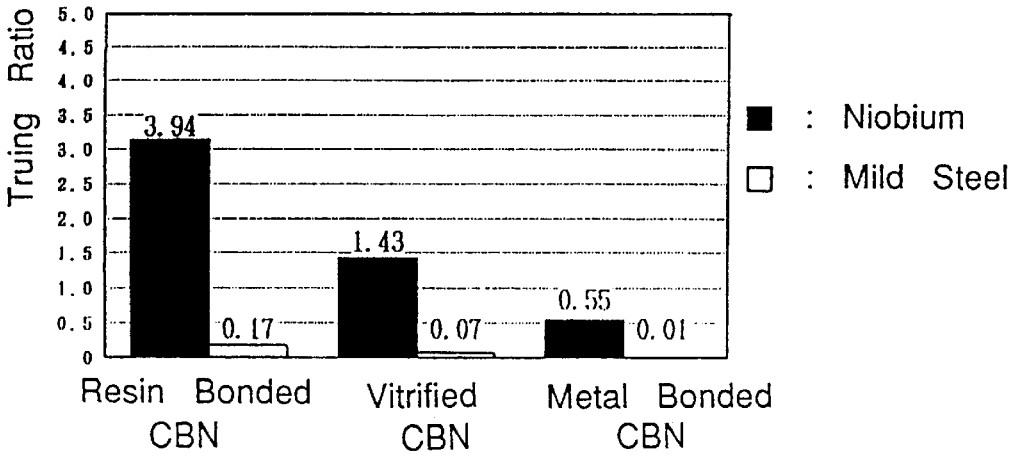
FIG. 3 is a graph showing the relation between the binding agent used in the super grinding wheel to be trued and the truing ratio.

As will be apparent from FIG. 3, excellent results were obtained with regard to all of the CBN super grinding wheels as tested. The sample containing the resin binder exhibited a higher truing ratio of 3.94, which is 23 times greater than the control. The sample containing the vitrified binder exhibited a truing ratio of 1.43, which is 20 times greater than the control. Further, the sample containing the metal binder exhibited a truing ratio of 0.55, which is 55 times greater than the control. Thus, niobium may true all of the CBN super grinding wheels with high efficiency.

EXAMPLE 5

This example was conducted to demonstrate the dressing capability of the present metals. A resin bonded CBN super grinding wheel (resin bonded CBN400) was used as the super grinding wheel to be trued. Niobium and a composite material of niobium and mild steel as shown in FIG. 6 were employed as the samples of the contacting member of the truing device. A conventional diamond dresser (i.e., an electro-deposited block type dresser # 60) was employed as the control. Further, a combination of the diamond dresser and a stick-like dressing tool made of WA was also employed as the control. To evaluate the dressing capability of the niobium and the composite material, the grinding power of the super grinding wheel after being trued was determined.

In this example, the samples and the controls were utilized under different conditions to true the super grinding wheel. With regard to each sample, the super grinding wheel was rotated at a rotational speed of 2700 rpm. The truing device was moved forward and rearward at a speed of 400 mm/min, while being moved rightward and leftward at a speed of 14 m/min. Further, the contacting member of the truing device was ground at a depth of cut of 2 micrometer/stroke. With regard to each control, the super grinding wheel was rotated at a constant surface speed of 1700 m/min. The diamond dresser was moved forward and rearward at a speed of 500 mm/min and was ground at a depth of cut of 2 micrometer/stroke. The stick-like dressing tool made of WA was manually operated for 30 seconds for additional dressing.

To determine the grinding power of the super grinding wheel trued by each of the samples and the controls, the super grinding wheel was subjected to plunge cutting by a heat-treated workpiece (HRC63) made of high-speed steel, SKH51. The super grinding wheel was rotated at a rotational speed of 2700 rpm. The workpiece was moved rightward and leftward at a speed of 12 m/min and was ground at a depth of cut of 2 micrometer/stroke. Simultaneously, load current was applied to a motor for driving the super grinding wheel and was monitored and read so as to determine the relation between the load current and the total depth of cut. Thus, the grinding power of the super grinding wheel was numerically or quantitatively determined. The data are shown in Table 4 below. Also, the cut surface roughness of the workpiece was determined after the total depth of cut of the workpiece reached 2.0 mm. The data are shown in Table 5 below.

TABLE 4

| Depth of Cut (mm) | Truing Device/Dressing Tool: Niobium | Nb + M.S.* | D.D.** (Control) | D.D. + WA*** (Control) |
|---|---|---|---|---|
| 0.004 | 2.3 A | 2.0 A | 6.0 A | 5.0 A |
| 0.01 | 2.3 A | 2.0 A | 10.0 A | 5.0 A |
| 0.02 | 2.3 A | 2.0 A | **** | 5.0 A |
| 0.1 | 2.2 A | 2.0 A | **** | 3.0 A |
| 0.5 | 2.1 A | 2.0 A | **** | 2.5 A |
| 1.0 | 2.1 A | 2.0 A | **** | 2.5 A |
| 1.5 | 2.1 A | 2.0 A | **** | 2.5 A |
| 2.0 | 2.1 A | 2.0 A | **** | 2.5 A |

*composite material made of niobium and mild steel
**diamond dresser
***diamond dresser and stick-like dressing tool
****too high (The workpiece cannot be ground.)

TABLE 5

| Truing Device / Dressing Tool | Appearance of Workpiece (Surface Roughness) |
|---|---|
| Niobium | 0.334 micrometer Ra |
| Nb + M.S. | 0.432 micrometer Ra |
| D.D. (Control) | 0.160 micrometer Ra (burning) |
| D.D. + WA (Control) | 0.162 micrometer Ra |

As will be apparent from Table 4, excellent results were obtained with regard to niobium and the composite material. In the super grinding wheel treated using niobium, a load current of only 2.3 A was determined immediately after starting the plunge cutting of the workpiece. In the super grinding wheel treated using the composite material, a load current of only 2.0 A was determined immediately after starting the plunge cutting of the workpiece. Further, such low load current values were substantially maintained until the total depth of cut of the workpiece reached 2.0 mm.

On the other hand, in the super grinding wheel treated using the conventional diamond dresser, a load current of 6.0 A was determined immediately after starting the plunge cutting of the workpiece. In the super grinding wheel treated using the combination, a load current of 5.0 A was determined immediately after starting the plunge cutting of the workpiece. Further, such load current values remarkably changed as the total depth of cut of the workpiece increased. In particular, in the super grinding wheel treated only using the diamond dresser, the load current was so high that the workpiece could not be further cut after the total depth of cut reached 0.02 mm. Thus, the super grinding wheel treated using niobium or the composite material exhibited higher grinding power without an additional dressing treatment and restored the power for a long time. Therefore, niobium and the composite material may exhibit better dressing capability than the conventional super grinding wheel.

Additionally, as shown in Table 5, the surface roughness of the workpiece cut by the super grinding wheel trued by niobium or the composite material was greater than the surface roughness of workpiece cut by the super grinding wheel trued for each control. As is well known, a super grinding wheel having higher grinding power will make the cut surface of the workpiece rough. This also means that the super grinding wheel treated by niobium or the composite material exhibited higher grinding power, that is, niobium and the composite material may exhibit better dressing capability with respect to the super grinding wheel.

This is because niobium reacts with the binding agent contained in the super grinding wheel to effectively remove the binding agent without damaging the abrasive grains of the super grinding wheel.

EXAMPLE 6

This example was conducted to demonstrate the usefulness or superiority of the present invention over the conventional methods. The data are shown in Table 6 below.

TABLE 6

| | 1 | 2 | 3 | 4 | 5 |
|---|---|---|---|---|---|
| Truing Power With Respect To Grinding Wheel | | | | | |
| Resin Bonded CBN | B | A | A | C | AA |
| Vitrified CBN | B | B | A | C | AA |
| Metal Bonded CBN | C | C | C | C | A |
| Resin Bonded Diamond | A | A | C | C | AA |
| Vitrified Diamond | B | A | A | C | AA |
| Metal bonded Diamond | C | C | C | C | A |
| Grinding Performance of Grinding Wheel | A | A | C | C | AA |
| Dressing After Truing | NN | NN | N | N | NN |
| Versatility | A | A | B | C | AA |
| Cost | B | B | B | C | AA |
| Operability | B | C | B | B | AA |

1: method utilizing mild steel
2: method utilizing a grindstone
3: method utilizing a diamond dresser
4: method utilizing electrical discharge
5: the present invention
AA: Superior
A: Good
B: Bad
C: Very Bad
NN: No Needed
N: Needed As will be apparent from Table 6, the present invention exhibits many specific advantages over the conventional methods. For example, the present method exhibits truing power that is greater than the conventional methods. Further, the present invention may be applied to various types of grinding wheels and may easily true the grinding wheel at a lower cost.

The preferred embodiments herein described are intended to be illustrative of the invention and not to limit the invention to the precise form herein described. These examples were chosen and described to explain the principles of the invention and their application and practical use to enable others skilled in the art to practice the invention.

What is claimed is:

1. A method of truing a grinding wheel mounted in a surface grinding machine, the grinding wheel comprising an abrasive, a binder, and a working surface to be trued, the method comprising:

rotating the grinding wheel at a constant rotational speed;

mounting a truing device to the surface grinding machine, the truing device comprising a truing material, the truing material comprising at least one truing metal and a matrix, the truing metal selected from the group consisting of titanium, zirconium, hafnium, vanadium, niobium, tantalum, chromium, molybdenum, tungsten, and alloys thereof, the matrix comprising a ferromagnetic material, the truing metal embedded in the matrix; and reciprocating the truing material at a constant speed tangentially to the rotation of the grinding wheel, thereby grinding the truing material with the working surface of the grinding wheel at a constant depth of cut per stroke, wherein the truing device is mounted to the surface grinding machine by magnetic force, and wherein a solid phase diffusion reaction and/or a chemical reaction is induced between the truing material and the binder of the grinding wheel as a result of frictional heat generated when the grinding wheel grinds the truing material, thereby producing a brittle reaction product formed of the truing material and the binder on the working surface of the grinding wheel, so that said reacted binder can be removed from the grinding wheel as the brittle reaction product.

2. A method of truing a grinding wheel mounted on a surface grinding machine, the grinding wheel comprising an abrasive and a binder and having a working surface to be trued, the method comprising inducing a solid phase diffusion reaction to produce a brittle reaction product by steps, including:

rotating the grinding wheel;

selecting a truing material comprising at least one metal from the group consisting of titanium, zirconium, hafnium, vanadium, niobium, tantalum, chromium, molybdenum, tungsten, and alloys thereof at a constant depth of cut;

the truing material embedded in a matrix comprising a ferromagnetic material;

mounting the truing device on a surface of the surface grinding machine by magnetic force induced by a magnetic chuck built into the surface of the surface grinding machine; and grinding the truing material with the working surface of the grinding wheel at a constant depth of cut per stroke by moving the grinding wheel stepwise toward the truing material, thereby inducing the solid phase diffusion reaction between the truing material metal and the grinding wheel binder to produce the brittle reaction product.

3. The method of claim 2, wherein the truing material is selected from the group consisting of chromium-tantalum, molybdenum-tantalum, tungsten-tantalum, chromium-niobium, molybdenum-niobium, and tungsten-niobium.

4. A method of truing a grinding wheel using a truing material, the grinding wheel mounted in a surface grinding machine, the grinding wheel comprising an abrasive and a binder and having a working surface, said method reacting the grinding wheel binder with the truing material to produce a brittle reaction product, the method including:

providing a truing device comprising the truing material, the truing material comprising a truing metal and a matrix, the truing material embedded within the matrix and selected from the group consisting of titanium, zirconium, hafnium, vanadium, niobium, tantalum, chromium, molybdenum, tungsten, and alloys thereof; the matrix comprising a ferromagnetic material;

rotating the grinding wheel at a constant speed;

mounting the truing device on a surface of the surface grinding machine by magnetic force induced by a magnetic chuck built into the surface of the surface grinding machine; and grinding the truing material with the working surface of the grinding wheel at a constant depth of cut per stroke by moving the grinding wheel stepwise toward the truing material, thereby producing the brittle reaction product on the grinding wheel working surface by way of a solid phase diffusion reaction induced from frictional heat produced by grinding the truing material with the working surface of the grinding wheel; and removing the brittle reaction product from the grinding wheel working surface.

* * * * *